United States Patent [19]

Speigel

[11] 4,221,991

[45] Sep. 9, 1980

[54] SEALED EFFUSIVE STRUCTURE FOR USE IN A CATHODE RAY TUBE

[75] Inventor: Kenneth Speigel, Seneca Falls, N.Y.

[73] Assignee: GTE Products Corporation, Stamford, Conn.

[21] Appl. No.: 972,636

[22] Filed: Dec. 22, 1978

[51] Int. Cl.[3] ..... H01J 19/70

[52] U.S. Cl. ..... 313/481; 313/174

[58] Field of Search ..... 313/481, 174, 177; 417/48

[56] References Cited

U.S. PATENT DOCUMENTS

| | | | |
|---|---|---|---|
| 2,536,879 | 1/1951 | Gabrielli | 417/48 |
| 3,979,633 | 9/1976 | Davis et al. | 313/481 |
| 4,029,987 | 6/1977 | Zuccinelli | 313/174 |

FOREIGN PATENT DOCUMENTS

| | | | |
|---|---|---|---|
| 2510814 | 9/1975 | Fed. Rep. of Germany | 313/174 |
| 762640 | 3/1966 | Italy | 417/48 |
| 1226798 | 3/1971 | United Kingdom | 313/481 |

*Primary Examiner*—Palmer C. Demeo

*Attorney, Agent, or Firm*—Thomas H. Buffton

[57] ABSTRACT

The invention provides a sealed effusive material structure for angular orientation within a cathode ray tube. The effusive material, which is disposed in an annular channelized container, is protectively sealed by a metallic covering that melts at a temperature above that encountered during panel-funnel sealing, and below that used for activation of the effusive material. Receptacle means integral with the container is provided to collect and retain the gravity flow of the melted covering material.

10 Claims, 4 Drawing Figures

SEALED EFFUSIVE STRUCTURE FOR USE IN A CATHODE RAY TUBE

TECHNICAL FIELD

This invention relates to effusive material structures for use in cathode ray tubes and more particularly to a sealed effusive material structure for utilization therein.

CROSS REFERENCE TO RELATED APPLICATION

This application contains matter disclosed but not claimed in a related United States patent application filed concurrently herewith and assigned to the assignee of the present invention. The related application is Ser. No. 962,637, filed Dec. 22, 1978.

BACKGROUND ART

The term "effusive material" encompasses sufficient breadth to include any vaporizable or effusive material that may be desirably diffused within environment of a cathode ray tube, such as gettering or gas adsorbing substances, selected gases, and discrete metallic deposits. Such effusive material structures have been positioned at various locations within the tube to achieve maximum accomplishment of the desired results.

For example, in color cathode ray tubes, gettering structures have been affixed to the forward end of the electron gun assembly and projected by support means to position adjacent to the coated interior surface of the funnel. During tube processing activation of getters so positoned, the effusive material emanating therefrom is usually deposited over an expansive area of the funnel-disposed conductive coating.

In certain types of tube constructions, two or more diverse electrically-related coatings are adjacently disposed on discrete interior areas of the funnel portion. In such instances, the dispersal of a broad area of gettering material thereover becomes a deleterious factor in that it may effect electrical leakage between the coated areas. While diffusion directive means have been fashioned and incorporated with the getter containers to control the effusion of material emanating therefrom, there are times when adequate and consistent control is difficult to achieve, especially when the effusive structure is positioned proximal to the diversely coated areas. To minimize the above problem, the effusive structure, such as a gettering means, has been mounted in the forward region of the tube envelope on a screen related member, such as the color tube shadow mask structure, prior to sealing the face panel to the funnel portion of the envelope. This prior-to-sealing positioning of the exemplary gettering means evidences disadvantages in that the ambient atmosphere in conjunction with the heat required for sealing of the panel to the funnel produces a temperature-related environment which adversely affects the subsequent quality of the effusive material.

DISCLOSURE OF INVENTION

The present invention obviates and reduces the aforementioned disadvantages of the prior art. In one aspect of the invention, the advantages achieved are realized by the provision of a sealed effusive structure formed substantially as an annular V-shaped channel member having an effusive material disposed within the channel. An annular metallic covering is fitted into the channel and secured therein in a manner to provide a seal over the effusive material. The covering material has a melting point within the range of substantially 500°-700°, which is higher than the processing temperatures encountered during panel-funnel sealing. Receptacle means is formed integral to the channel to receive and retain the melted covering material which is removed in a subsequent processing procedure immediately prior to the release of the effusive material. The sealed structure provided by the invention protects the effusive material therein from heat and associated atmospheric deterioration during panel-funnel sealing. Thus, the desired benefits of the effusive material are fully available to achieve the most advantageous results at the proper time in the tube processing procedure.

BEST MODE FOR CARRYING OUT THE INVENTION

For a better understanding of the present invention, together with other and further advantages and capabilities thereof, reference is made to the following specification and appended claims in connection with the aforedescribed drawings.

Figure 1:
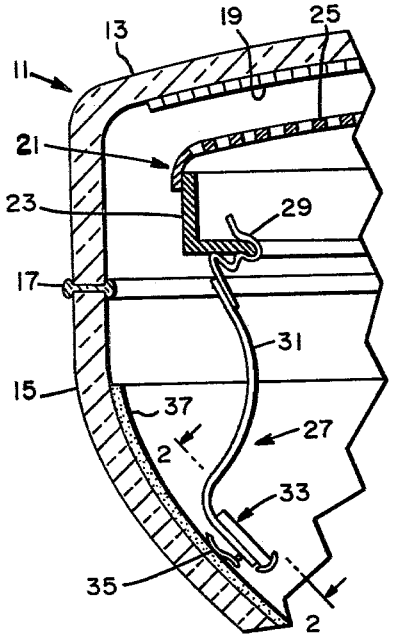
FIG. 1 is a partially sectioned view of a cathode ray tube illustrating the orientation of the effusive material structure therein.

With reference to the drawings, FIG. 1 illustrates a partially sectioned view of an exemplary color cathode ray tube 11 whereof the face panel portion 13 is joined to the funnel portion of the envelope 15 by a peripheral seal of a frit material 17 therebetween. In this instance, the panel member has a patterned cathodoluminescent screen 19 disposed on the inner surface thereof. Spatially oriented within the confines of the panel 13, and adjacent to the screen, is a screen-related discretely apertured member 21, as for example a shadow-mask or open-patterned electrode structure. Usually such screen-related members are comprised of a supportive framing means 23 to which the apertured element 25 is affixed. The positioning of this screen-related structure within the panel is effected by conventional means not shown.

Figure 2:
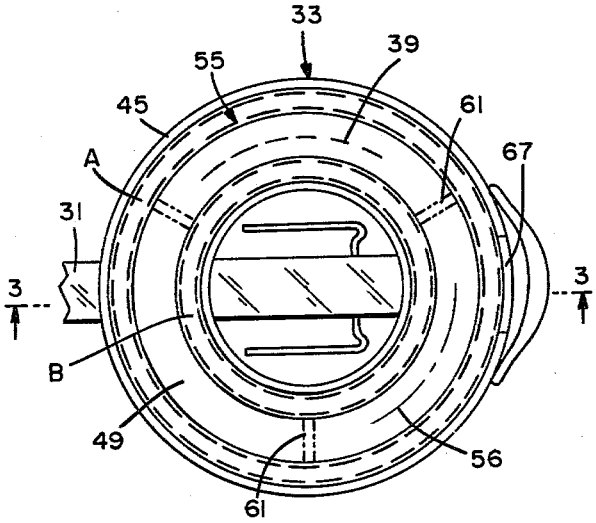
FIG. 2 is an enlarged plan view of the material effusive structure of the invention taken along the line 2—2 of FIG. 1.
Figure 3:
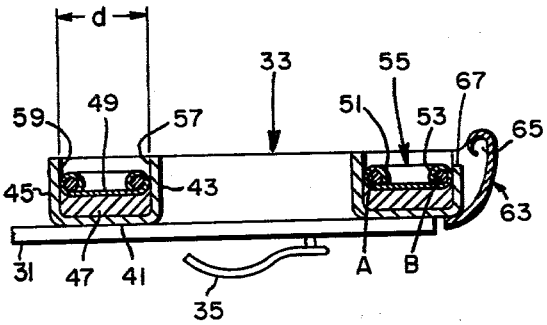
FIG. 3 is a sectional illustration of the material effusive structure taken along the line 3—3 of FIG. 2.

The effusive material structure of the invention 27 is affixed to the mask framing means 23 by suitable attachment means, such as the spring clip 29 and an associated wand or longitudinal supporting member 31. Terminally oriented upon the supporting member is an annular container means 33, which as further delineated in FIGS. 2 and 3, is substantially structured as an open continuous U-shaped channel wherein the effusive material is contained. A conventional sled or rest member 35 may be employed if deemed necessary to prevent the container from contacting the coating 37 disposed upon the inner surface of the funnel.

In greater detail, the U-shaped channel container 33, having a curved center-line 39 therearound, is formed to have a bottom portion 41 wherefrom inner and outer upstanding walls 43 and 45 separately extend as spatially-related concentric formations. Containers of this type are usually fabricated of stainless steel, such as 305 material, which has a melting point much higher than any temperatures encountered during CRT manufacture.

An effusive material 47 is uniformly disposed within the confines of the channel. As previously stated, the effusive material is chosen for the intended functional requirement, and may be one or a combination of substances of which the activated diffusion provides gas adsorption, a selected gaseous atmosphere or a thin metallic film. For purposes of example, a gettering structure will be described henceforth herein. The gettering material may be either endothermic or exothermic. Conventional getter alloys are those of substantially barium and aluminum and sometimes nickel. Depending upon the formulation, the flashing or vaporization temperatures of such materials are substantially within the range of about 750° to 1100° C.

An annular metallic covering 49 is fitted into the channel container 33 atop the getter material 47 and secured therein in a manner to form a substantially hermetic contiguous seal over the effusive material. This covering 49 is formed of a material having a melting temperature higher than any of the sealing and processing temperatures to which it may be subjected during tube processing prior to that encountered for getter activation. The highest prior temperature ambient to the getter location occurs during the panel-funnel sealing operation, and may be in the order of 450° C. A suitable covering material is one such as aluminum, which has a melting point of 660° C. The preferred thickness of the covering is in the order of 2 to 5 mils (0.051–0.127 mm.) to assure adequate protection.

Figure 4:
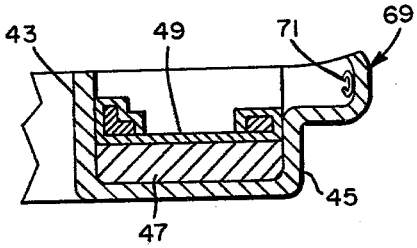
FIG. 4 is an enlarged sectional portion of the effusive structure illustrating additional embodiments of the invention.

One means for securing the covering 49 within the container 33 is to form the covering material as a substantially planar annular member, whereof the width dimension is substantially greater than the internal width dimension "d" of the channel at the surface of the disposed getter material 47. The circumferential edges 51 and 53 of the covering material 49 are rolled inwardly around a pair of Alpha "A" and Beta "B" metallic rings of suitable differing circumferences, formed of material similar to that of the container. This provides a substantially unitized covering structure 55 which is securely press-fitted within the channel, the center-line of the covering 56 being substantially perpendicularly coincidental with the container center-line 39. Thus, the "A" ring portion is contiguous with the upper portion 57 of the inner channel wall 43, and the "B" ring portion contiguous with the upper portion 59 of the outer channel wall 45. Since the coefficients of thermal expansion of the rings and the container are similar, a substantially hermetic seal is achieved. As shown in FIG. 2, greater rigidity can be imparted to the unitized covering structure 55 by providing at least three traverse support members 61 between the "A" and "B" cover-securing rings. As shown in FIGS. 3 and 4, the cross-sectional configurations of these rings may be round, square or L-shaped, or variations thereof.

Integrally associated with the container 33 is a receptacle means 63 which is formed to receive and retain the melted covering material that is liquified immediately prior to vaporization of the getter material. Since the getter container 33 is oriented in an angular position within the tube, the receptacle means 63 is located on the container in a manner to collect the gravity flow of the melted covering material. As illustrated in FIGS. 2 and 3, the exemplary receptacle is an added member 63 affixed to the container as by welding, the two materials being substantially similar. The receptacle incorporates formed retention means, such as a partially inwardly rolled formation of the lip portion 65, to secure the solidified covering material collected therein. It is to be noted that the outer wall 45 of the container has a depressed area 67 to allow the melted covering material to enter the receptacle.

In referring to FIG. 4, there is shown another embodiment of the receptacle means wherein a receptacle 69 is achieved by a deformation of the channel structure particularly relating to a portion of the outer container sidewall 45. This deformation is localized to substantially the upper portion of the sidewall. In this instance, the retention means for securing the solidified covering material is in the form of at least one internally oriented projection 71, extending from the interior surface thereof, such as a small configuration of wire welded thereto.

While there has been shown and described what are presently considered the preferred embodiments of the invention, it will be obvious to those skilled in the art that various changes and modifications may be made therein without departing from the scope of the invention as defined by the appended claims.

INDUSTRIAL-APPLICABILITY

The aforedescribed sealed effusive structure has advantageous utilization in CRT manufacture, particularly in the area of color tubes. The sealed getter is attached to the mask frame before the panel and the funnel are assembled at the entrance of the frit sealing lehr. Since the getter is sealed by a metal not affected by the heat encountered at panel-funnel sealing, protection is provided to the getter material preventing oxidation or otherwise deterioration thereof during the frit-lehr temperature cycle. The sealed panel-funnel assembly then moves to gun sealing and on to exhaust. Shortly into the exhaust cycle, the sealed getter is RF heated to about 660° C., or slightly higher, whereupon the getter seal melts and by gravity flow is collected and retained in the channel-related receptacle. Thus, the getter material is exposed to the vacuum environment within the tube. Upon completion of exhaust, the tube is sealed and the getter RF flashed as in conventional practice.

The invention provides several advantages not heretofore achieved. Installation of the sealed getter on the mask frame assembly is easily and securely accomplished prior to panel-funnel sealing. Thus, there is no scraping of loose particles of coating as was often prevalent when subsequently introducing the getter structure through the neck of the sealed panel-funnel assembly. More accurate positioning of the getter can be accomplished thereby insuring optimum flashing. Since the getter material is protected during panel-funnel sealing and a major portion of the exhaust cycle, the ensuing getter deposition within the envelope provides a finished tube of enhanced quality.

What is claimed is:

1. An effusive material structure for internal orientation within a cathode ray tube comprising:

a metallic annular container formed as an open continuous U-shaped channel having a center-line therearound, said channel being formed to have a bottom portion wherefrom inner and outer upstanding walls extend in spatially-related concentric formations;

an effusive material uniformly disposed within the confines of said channel, said inner and outer upstanding walls being of sufficient height to each have an annular upper portion extending above said effusive material uniformly disposed within the confines of said channel;

an annular metallic covering material fitted into said channel and secured therein in a manner to form a substantially contiguous seal over said effusive material and having a melting point within the range of about 500°–700° C.;

receptacle means integral to said metallic annular container and formed to receive and retain said covering material upon having reached said melting point; and attachment means joined to said metallic annular container to provide affixation thereof to an internal structure within said cathode ray tube.

2. The effusive material structure according to claim 1 wherein said receptacle means is oriented relative to said metallic annular container in a manner to receive and retain the gravity flow of said metallic covering material upon attainment of said melting point thereby.

3. The effusive material structure according to claim 1 wherein said receptacle means is formed as a deformation of said outer upstanding wall of said U-shaped channel.

4. The effusive material structure according to claim 1 wherein said receptacle means includes a formed retention means for securing said covering material therein upon attainment thereby of said melting point and return thereof to a solidified state.

5. The effusive material structure according to claim 4 wherein said formed retention means of said receptacle means includes at least one projection extending from the interior surface of said retention means toward said annular container.

6. The effusive material structure according to claim 4 wherein the retention means of said receptacle means is in the form of at least one internally oriented projection.

7. The effusive material structure according to claim 1 wherein said covering material is substantially aluminum.

8. The effusive material structure according to claim 1 wherein said covering material is formed as a substantially planar annular member having a center-line therearound substantially perpendicularly coincidental with that of said U-shaped channel, said covering material having a width dimension substantially greater than the internal width dimension of said U-shaped channel at the surface of said disposed effusive material, said covering being secured within said channel by pressfit securing means in the form of A and B metallic rings of differng circumferences fabricated of material similar to that of said container, said covering having circumferential edges thereof rolled inwardly over said A and B metallic rings to provide a substantially unitized structure whereof said covering rolled inwardly over said A metallic ring is contiguous with the upper portion of said inner upstanding wall of said U-shaped channel and the covering rolled inwardly over said B metallic ring is contiguous with the upper portion of said outer upstanding wall of said U-shaped channel.

9. The effusive material structure according to claim 8 wherein said covering rolled inwardly over said A and B metallic rings has at least three spatially related transverse support means thereacross.

10. An effusive material structure for internal angular orientation within a cathode ray tube comprising: channalized annular container means having an effusive material disposed therein; a metallic covering applied as a protectable seal over said effusive material, said covering being of a material having a melting temperature above that encountered during CRT processing and below that used for activation of said effusive material; receptacle means integral with and external to said container having said effusive material therein to collect and retain melted covering material flowing therein by gravity flow; and attachment means affixed to said container to provide positioning thereof on an internal structure within said cathode ray tube.

* * * * *